US006561274B1

(12) United States Patent
Hayes et al.

(10) Patent No.: US 6,561,274 B1
(45) Date of Patent: May 13, 2003

(54) METHOD AND APPARATUS FOR UNLOADING WELL TUBING

(75) Inventors: Anthony V. Hayes, Bartlesville, OK (US); Kenneth R. Sundberg, Silva, NC (US)

(73) Assignee: Conoco Phillips Company, Houston, TX (US)

( * ) Notice: Subject to any disclaimer, the term of this patent is extended or adjusted under 35 U.S.C. 154(b) by 0 days.

(21) Appl. No.: 09/995,344

(22) Filed: Nov. 27, 2001

(51) Int. Cl.[7] ..... E21B 21/16

(52) U.S. Cl. ..... 166/311; 166/105.5; 166/272.1; 102/326; 102/328; 175/4.54; 429/31; 429/35; 429/38; 431/202; 340/856.2

(58) Field of Search ..... 166/53, 105.5, 166/272.1, 311; 175/4.54, 4.58; 102/326–328; 429/30–32, 35, 38; 431/202; 340/856.2

(56) References Cited

U.S. PATENT DOCUMENTS

| | | | | |
|---|---|---|---|---|
| 3,833,059 | A | | 9/1974 | Sisson |
| 4,728,584 | A | * | 3/1988 | Isenberg |
| 5,775,426 | A | | 7/1998 | Snider et al. |
| 6,456,902 | B1 | * | 9/2002 | Streetman |
| 6,467,387 | B1 | * | 10/2002 | Espinosa et al. |

* cited by examiner

*Primary Examiner*—Roger Schoeppel
(74) *Attorney, Agent, or Firm*—Kameron D. Kelly

(57) ABSTRACT

A system for unloading fluids from a generally upright tubular member of a wellbore wherein a combustible fuel cell can be placed in the tubular member below the fluid and ignited to generate gasses. The gasses generated by the burning of the fuel cell can be used to force at least a portion of the fluid upward out of the tubular member.

20 Claims, 1 Drawing Sheet

METHOD AND APPARATUS FOR UNLOADING WELL TUBING

BACKGROUND OF THE INVENTION

1. Field of the Invention

The present invention relates generally to systems for unloading fluids from generally upright tubular members of a wellbore. In. another aspect, the invention concerns a method and apparatus for efficiently and effectively unloading fluids from production tubing of a subterranean hydrocarbon well by utilizing a fuel cell to generate content-lifting gases in the tubing.

2. Discussion of Prior Art

In preparation for producing, and during the production of, hydrocarbons from subterranean formations, it is often necessary to unload the fluid contents of a fluid-filled production tubing string before hydrocarbon production can begin or continue. For example, certain processes either involve introducing fluid into the production tubing that must later be removed prior to production (e.g., drilling fluids, fracturing fluids, completion fluids, production fluids, etc.) or require fluids already in the production tubing to be removed (e.g., water, oil, condensate, etc.).

There are systems known in the art for unloading contents from well tubing. For example, well operators typically run coiled tubing into the well and pump the contents out of the production tubing. It is also known in the art to introduce certain gases (e.g., nitrogen) into a liquid-filled tubular to create a "bubbling" lifting force to assist in removing liquid from the tubing string.

These prior art systems are problematic and suffer from several limitations. For example, the coiled tubing, while effective, is inefficient as it is considerably time-consuming and requires significant additional equipment and materials to operate. Prior methods of unloading a well using gases are ineffective and may expose the formation or casing annulus to undesired elevated pressure in order to introduce sufficient gases into the well.

SUMMARY OF THE INVENTION

The present invention provides an improved system for unloading fluids from tubular members (e.g., tubing or casing) of a wellbore that does not suffer from the problems and limitations of the prior art systems as set forth above. The inventive system provides a way to effectively and efficiently unload fluids from a well tubing or casing without exposing the formation or casing to undesired elevated pressure.

In accordance with one embodiment of the present invention, a method of unloading a fluid from a generally upright tubular member of a wellbore is provided. The method comprises the steps of: (a) placing a combustible fuel cell inside the tubular member under the fluid to be unloaded; (b) burning the fuel cell to generate a gas in the tubular member; and (c) using the gas to force at least a portion of the fluid upward out of the tubular member.

In accordance with another embodiment of the present invention, an apparatus for unloading a fluid contained in a generally upright tubular member of a wellbore is provided. The apparatus generally comprises a combustible and expandable fuel cell, a cap coupled to the fuel cell, and an ignition device coupled to the fuel cell. The fuel cell is adapted to be received in the tubular member. The fuel cell defines an internal chamber which is adapted to be filled with a gas generated by the fuel cell when the fuel cell is burned. The cap is operable to hold the gas in the internal chamber until the pressure of the gas in the internal chamber causes the fuel cell to expand sufficiently to form a seal with the tubular member. The ignition device is operable to initiate burning of the fuel cell when the ignition device is actuated.

In accordance with a still further embodiment of the present invention, a wellbore extending into a subterranean formation is provided. The wellbore comprises a generally upright tubular member, a fluid disposed in the tubular member, a combustible fuel cell disposed in the tubular member generally below at least a portion of the fluid, and an ignition device coupled to the fuel cell. The fuel cell is operable to generate a gas when burned. The ignition device is operable to initiate burning of the fuel cell when the ignition device is actuated.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

DETAILED DESCRIPTION OF THE PREFERRED EMBODIMENTS

Figure 1:
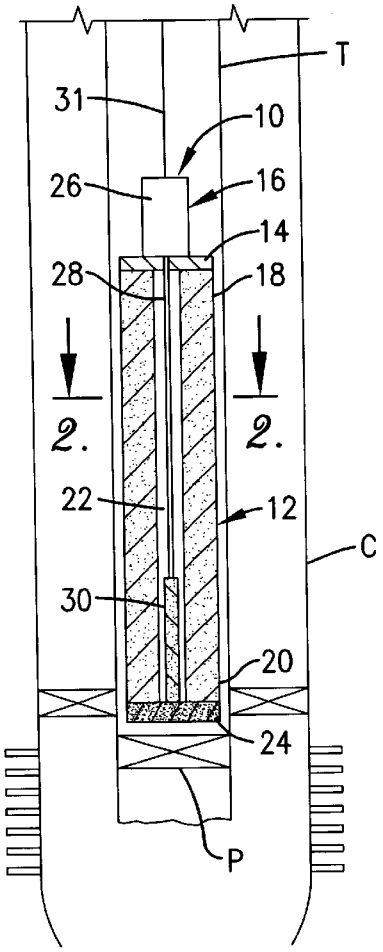
FIG. 1 is a partial sectional view of an apparatus for unloading well tubing constructed in accordance with the principles of the present invention and shown schematically in a plugged production tubing inside a perforated well casing.

Turning initially to FIG. 1, the apparatus 10 for unloading well tubing selected for illustration is shown submerged at the bottom of a production tubing T for producing hydrocarbons from a subterranean well. The production tubing T is filled with fluid (e.g., water, oil, condensate, drilling fluids, fracturing fluids, completion fluids, production fluids, etc.). The production tubing is plugged by a plug P. The tubing T is located in a perforated well casing C. However, the principles of the present invention are applicable to unload the contents of virtually any kind of tubular in any type of well. For example, the present invention could be utilized to unload fluid contents from a well casing. The apparatus 10 broadly includes a combustible fuel cell 12 operable to generate content-lifting gases as it combusts, a cap 14 cooperating with the cell 12 to provide a desired seal, and an ignition assembly 16 operable to ignite the cell 12.

The fuel cell 12 is adapted to be inserted into the tubing T and positioned below the fluid to be unloaded therefrom. In particular, the illustrated fuel cell 12 is generally cylindrical in shape and includes an upper end 18 and a lower end 20 axially spaced from the upper end 18. The fuel cell 12 preferably has a generally annular cylindrical configuration and defines an outer diameter (prior to ignition) that is less than the inner diameter of the tubing T (e.g., typical production tubing has an inner diameter between 2 and 7 inches). Because the fuel cell 12 is inserted into a fluid-filled well tubing, it is important that the outer diameter of the fuel cell 12 provide sufficient clearance between the inner wall of the tubing T to allow the fuel cell 12 to be submerged to the desired position—i.e., below the fluid to be unloaded (e.g., typically this will be towards or at the bottom of the well tubing). However, for purposes that will subsequently be described, it is further important that the outer diameter of the illustrated fuel cell 12 be as large as possible and still allow the desired insertion clearance.

Figure 2:
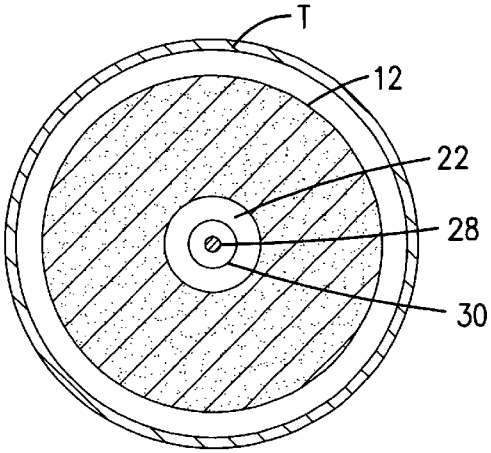
FIG. 2 is a sectional view of the apparatus taken substantially along line 2—2 of FIG. 1.

As shown in FIGS. 1 and 2, the illustrated fuel cell 12 defines an internal burn hole 22. The burn hole 22 is generally located around the central longitudinal axis of the fuel cell 12 and extends between the upper and lower ends 18,20. The burn hole 22 is configured to influence the rate at which the fuel cell 12 burns once it is ignited (e.g., accelerating over time). It is believed the rate at which the fuel cell 12 burns will be proportional to the surface area of fuel exposed to the hot gases created by the burn. For purposes that will subsequently be described, it is important for the illustrated fuel cell 12 to burn slowly at first (e.g., just after ignition) so that the corresponding pressure created by the gases formed in the burn also builds slowly at first. In this regard, the surface area of fuel exposed to the burn will, upon ignition, initially be limited to the surface area of fuel defining the internal burn hole 22. However, as the fuel burns, the diameter of the burn hole 22 will expand, thereby exposing more surface area of fuel to the burn. It is believed that as the surface area of fuel exposed to the burn increases, the rate of combustion of the fuel cell also increases.

As previously indicated, the fuel cell 12 is combustible and operable to generate content-lifting gases as it combusts. In this regard, the illustrated fuel cell 12 is preferably formed from an expandable propellent-type material that burns at a relatively slow rate of combustion, produces relatively large amounts of gases as it bums, burns without utilizing heat or oxygen external to the cell 12, and substantially incinerates when burned. As will subsequently be described in detail, the fuel cell 12 may operate as a "rocket assist" to create a gas bubble that drives the fluid up and out of the tubing string T. Depending on the application, a tubing string could be as much as 10,000 feet deep and filled with fluid that must be unloaded. It is therefore important that the fuel cell 12 burn at a slow enough rate of combustion to prevent damaging the tubing string T and create a sufficient and sustained lifting force to unload the vast amount of fluid out of the top of the tubing string T. For example, an explosion-type burn is undesired because it could both damage the tubing string and may not sufficiently expel the fluid out of the top of the tubing string. In an exemplary application involving a 7 inch diameter tubing filled with fluid to a depth of 5000 feet, a representative burn rate would be 2–3 minutes for a fuel cell having an axial length of around thirty feet. It is also important that the fuel cell 12 produce large amounts of gases as it burns in order to create the necessary lifting force to drive the fluids up the tubing string T and expel them out of the top of the string T. Because the fuel cell 12 is ignited once it has been submerged beneath the fluids to be unloaded, it is further important that the cell 12 burn without the need to utilize heat or oxygen from a source external to the cell 12. To facilitate cleaning the tubing string after it has been unloaded, it is preferred that the fuel cell 12 substantially incinerate upon burning. In this regard, it is preferred that the fuel cell 12 be formed from a propellant-type material that exists in a solid form (e.g., gel-like, etc.) to eliminate the need for any casing structure. An exemplary material suitable for the construction of the fuel cell 12 is available from Atlantic Research Corporation, Gainesville, Va., under the trade name ARCITE 479. However, it is within the ambit of the present invention to utilize virtually any material having the desired burn characteristics. For example, a liquid fuel cell packed in a solid casing could be utilized.

The cap 14 cooperates with the fuel cell 12 to provide a seal below the fluid to be unloaded from the well tubing T after the fuel cell 12 is positioned therein. In the illustrated apparatus 10, the cap 14 is integrally formed with the fuel cell 12 proximate the upper end 18 and is formed from a similar combustible propellant-type material. The cap 14 is configured to control the pressure within the fuel cell 12 after the cell 12 is ignited until a threshold pressure is achieved. In particular, the fuel cell 12, once ignited, begins to burn thereby creating gases. During these early stages of the burn, the cap 14 prevents the gases from exiting the upper end 18 of the cell 12 thereby causing pressure to build within the cell 12. As the pressure builds, it causes the fuel cell 12 to radially expand until the circumferential surface thereof seals against the inside wall of the tubing T. Once the cell 12 seals against the tubing T, the cell 12 continues to burn (at a faster rate) producing more gases and thereby building further pressure. During these middle stages of the burn, the cap 14 continues to prevent the gases from exiting the upper end 18 of the cell 12. During these middle stages of the burn, the pressure eventually overcomes the friction forces between the circumferential surface of the cell 12 and the inner wall of the tubing T causing the unburned portion of the cell 12 to begin to shift upwards. Although the unburned portion of the cell 12 loses its frictional grip on the internal wall of the tubing T, it maintains the seal between the contents above the cell 12 and the gases therebelow. As the cell 12 shifts up the tubing T, fluid above the cell 12 is driven up the tubing T. Once the cell 12 has begun to drive the fluid up the tubing T, the cell 12 continues to burn (at still a faster rate) producing even more gases and thereby building even further pressure. During these late stages of the burn, the cap 14 ruptures allowing the gases within the cell 12 to expand out of the cell 12. As the gases expand out of the cell 12, they force the fluid inside the tubing T upward until the fluid is expelled therefrom. Once the fluid is expelled from the tubing T, the gases vent to the surface atmosphere out of the tubing T. During these final stages of the burn, any fuel remaining in the tubing T continues to burn until it is consumed leaving the tubing T unloaded and clean.

The illustrated apparatus 10 includes a bottom cap 24 integrally formed with the fuel cell 12 proximate the lower end 20. The bottom cap 24 is formed from a similar combustible material so that it is consumed during the final stages of the burn. However, the bottom cap 24 is configured to withstand pressure in excess of the pressure at which the cap 14 ruptures. In this manner, the bottom cap 24 protects anything down-hole of the cell 12 from the gases generated thereby. For example, the bottom cap 24 prevents the gases generated by the cell 12 from penetrating the well, the perforations, the formation, etc. It is within the ambit of the present invention to utilize alternative fuel cell configurations that do not utilize a bottom cap. It is also within the ambit of the present invention to utilize a plug (e.g., the plug P) to prevent the cell-generated gases from escaping down-hole. If a plug is used, it must be placed in the well tubing prior to inserting the fuel cell (e.g., in any manner commonly known in the art) and can be removed once the well is unloaded (e.g., using a slick line, etc.). It is preferred to utilize a plug to protect the sand face of the formation when the well has already been perforated.

As previously indicated, the ignition assembly 16 is operable to ignite the fuel cell 12 after the cell 12 is positioned in the tubing T. The illustrated assembly 16 includes an electric triggering device 26, a communication wire 28, and a fuse 30. The triggering device 26 is located on top of the cap 14 and includes a connecting element (not shown) adapted to electrically, mechanically, and removably connect the triggering device 26 to a well line. For example, the illustrated apparatus 10 is preferably coupled to a wire-line 31 for inserting the apparatus 10 into the well tubing T and setting it in its submerged position therein. The wire-line 31, in a manner known in the art, also carries electric current from a source external to the well tubing T. The wire-line 31 conveys the electric current to the triggering device 26. The triggering device 26 is electrically coupled to the communication wire 28. The wire 28 is in firing communication with the fuse 30. The triggering device 26 generates a firing signal that is conveyed through the communication wire 28 to the fuse 30 where the firing signal causes the fuse 30 to light. The fuse 30, once lit, starts the fuel cell 12 burning. The fuse 30 is positioned in the burn hole 22 adjacent the lower end 20 of the cell 12 so that the cell 12 begins burning at the lower end 20 and burns radially outward from the burn hole 22. It is preferred that the wire-line 31 be removed once the firing signal has been generated. It is within the ambit of the present invention to utilize alternative ignition assemblies. For example, the triggering device 26 could be a time trigger or a pressure trigger that do not require the use of a wire-line to either set the apparatus 10 or deliver electric current thereto. However, it is important that the ignition assembly be able to ignite the cell 12 at a desired location after the cell 12 is submerged in the desired position in the well tubing T.

Figure 3:
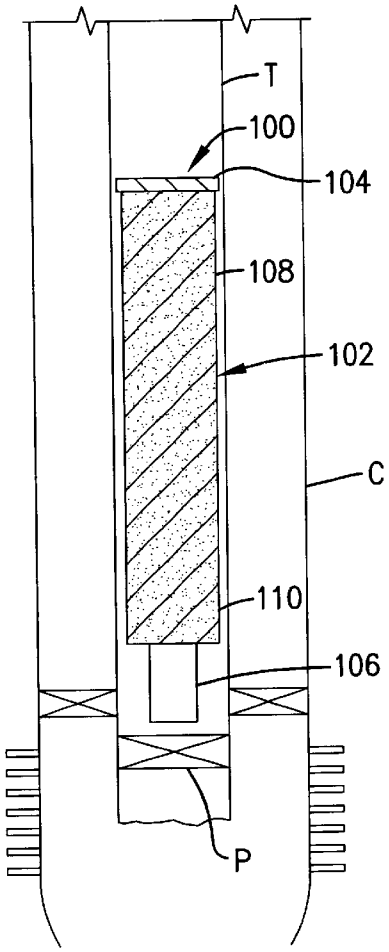
FIG. 3 is a partial sectional view of an alternative apparatus for unloading well tubing constructed in accordance with the principles of the present invention and shown schematically in a plugged production tubing inside a perforated well casing.

It is within the ambit of the present invention to utilize various alternative configurations, designs, materials, etc. for the apparatus for unloading well tubing. However, it is important that the apparatus is configured to be submerged in the fluid in the well tubing, ignited therein, and operable to generate content-lifting gases which can be used to drive the fluid contents up the tubing and expel them therefrom. An alternative embodiment is the apparatus 100 for unloading well tubing as illustrated in FIG. 3. The apparatus 100 is illustrated in an environment similar to the environment previously discussed above with respect to the apparatus 10. That is, the apparatus 100 is illustrated submerged toward the bottom of a plugged fluid-filled well tubing T that is incased in a perforated well casing C. The apparatus 100 broadly includes a combustible fuel cell 102 operable to generate content-lifting gases as it combusts, a plunger 104 operable to displace fluids in the tubing T when shifted within tubing T, and an ignition assembly 106 operable to ignite the cell 102.

The fuel cell 102 is similar to the previously discussed fuel cell 12, however, for reasons that will subsequently become clear, the fuel cell 102 need not be expandable and therefore does not include either a burn hole or a bottom cap. The fuel cell 102 is generally cylindrically shaped and includes axially spaced upper and lower ends 108 and 110, respectively. Other than the need to be expandable, the fuel cell 102 includes all of the burn qualities previously detailed with respect to the fuel cell 12 and is preferably formed of the same or a similar material.

The plunger 104 may provide a slidable seal below the fluid to be unloaded from the well tubing T after the fuel cell 102 is positioned in the well tubing T. The plunger 104 is positioned proximate the upper end 108 of the fuel cell 102. The illustrated plunger 104 is shown in contact with and coupled to the cell 102, however, it is within the ambit of the present invention for the plunger to be spaced from the upper end 108 of the fuel cell 102. The plunger 104 may be adapted to create and maintain a mechanical seal with the inside wall of the well tubing T. In this regard, the plunger 104 is preferably not formed from a propellant-type material. There are several ways known in the art to create a down-hole mechanical slidable seal inside a well tubing (e.g., elastomeric seals, spring-biased sealing pads, etc., that are typically used in artificial plunger lift systems) and any of these can be utilized to seal the plunger 104. It is also within the ambit of the present invention to utilize non-mechanical seals, such as a grooved cap sealed by upward gas flow. However, it is important that the seal be adapted to slide up the well tubing T while maintaining a relationship with the inner wall of the well tubing T sufficient to displace at least a portion of the fluid contents to be unloaded. In this regard, the plunger 104 may not completely seal against the inner wall of the well tubing T. It is within the ambit of the present invention to utilize a plunger 104 having an outer diameter that provides sufficient clearance from the inner diameter of the well tubing T to allow the apparatus to "drift" down the fluid-filled tubing T during insertion into the desired unloading position in the tubing T. However, the clearance between the outer diameter of the plunger 104 and the inner diameter of the tubing T should be sufficiently minimal so that when the fuel cell 102 is ignited and begins to generate content-lifting gases, the plunger 104 isolates at least a substantial portion of the fluid contents to be unloaded from the fuel cell 102.

As the fuel cell 102 begins to burn, the pressure of the generated gas builds below the plunger 104 until the gases drive the plunger 104 up the well tubing T. As the plunger 104 slides up the tubing T, the fluid above the plunger 104 is also driven up the tubing string T until it is expelled out of the top of the tubing T.

The ignition assembly 106, unlike the previously described assembly 16, preferably comprises a pressure triggering device. The ignition assembly 106 is coupled to the lower end 110 of the cell 102. In one manner known in the art, the pressure trigger of the assembly 106 ignites once the trigger is exposed to a threshold pressure (e.g., ignition instigated by the weight of the cell 102 and the fluids thereabove compressing the assembly 106 against the plug toward the bottom of the tubing T). Once the trigger is ignited, it burns through the lower end 110 of the cell 102 thereby igniting the cell 102. An exemplary pressure trigger device suitable for use in the ignition assembly 106 is available from Pacific Scientific Energetic Materials Co., Chandler, Ariz. as model no. PS-190 CP/HNS.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A method of unloading a fluid from a generally upright tubular member of a wellbore, said method comprising the steps of:

(a) placing a combustible fuel cell inside the tubular member under the fluid to be unloaded;

(b) burning the fuel cell to generate a gas in the tubular member; and (c) using the gas to force at least a portion of the fluid upward out of the tubular member.

2. The method as claimed in claim 1; and (d1) trapping the gas inside the now burned fuel cell to thereby cause expansion of the now burned fuel cell.

3. The method as claimed in claim 2, step (d1) including the step of creating a seal between an outside surface of the now burned fuel cell and an inside surface of the tubular member, thereby fluidly isolating the fluid located generally above the now burned fuel cell from the gas located generally below the now burned fuel cell.

4. The method as claimed in claim 3, step (c) including the step of increasing the pressure of the gas located generally below the now burned fuel cell to a level which causes the now burned fuel cell to slide upward in the tubular member, thereby forcing at least a portion of the fluid upward out of the tubular member.

5. The method as claimed in claim 1; and (d2) coupling an ignition device to the fuel cell, said ignition device capable of initiating burning of the fuel cell when the ignition device is actuated.

6. The method as claimed in claim 5; and (e) actuating the ignition device.

7. The method as claimed in claim 6, said ignition device being actuated in response to exposure to a pre-selected amount of pressure.

8. The method as claimed in claim 6, said ignition device being actuated by an electrical current sent to the ignition device via a wire-line disposed in the tubular member above the fuel cell.

9. An apparatus for unloading a fluid contained in a generally upright tubular member of a wellbore, said apparatus comprising:

a combustible and expandable fuel cell adapted to be received in the tubular member, said fuel cell defining an internal chamber adapted to be filled with a gas generated by the fuel cell when the fuel cell is burned;

a cap coupled to the fuel cell and operable to hold the gas in the internal chamber until the pressure of the gas in the internal chamber causes the fuel cell to expand sufficiently to form a seal with the tubular member; and an ignition device coupled to the fuel cell and operable to initiate burning of the fuel cell when the ignition device is activated.

10. The apparatus as claimed in claim 9, said fuel cell being formed of a material which, once ignited, can continue to burn without using an external heat source or external oxygen.

11. The apparatus as claimed in claim 10, said cap being formed of a combustible material which, once ignited, can continue to burn without using an external heat source or external oxygen.

12. The apparatus as claimed in claim 9, said ignition device being actuatable in response to exposure to a pre-selected amount of pressure.

13. A wellbore extending into a subterranean formation, said wellbore comprising:

a generally upright tubular member;

a fluid disposed in the tubular member;

a combustible fuel cell disposed in the tubular member generally below at least a portion of the fluid, said fuel cell operable to generate a gas when burned; and an ignition device coupled to the fuel cell and operable to initiate burning of the fuel cell when the ignition device is actuated.

14. The well bore as claimed in claim 13, said fuel cell defining an internal channel within which the gas can be trapped when the fuel cell burns, said fuel cell being formed of an expandable material, said fuel cell creating a seal with the tubular member when the pressure of the gas in the interior channel is high enough to sufficiently expand the fuel cell within the tubular member.

15. The wellbore as claimed in claim 14, said gas operable to force the fuel cell to slide upward in the tubular member when the pressure of the gas disposed generally below the fuel cell is sufficiently high.

16. The wellbore as claimed in claim 13, said ignition device being actuatable in response to exposure to a pre-selected amount of pressure.

17. The well bore as claimed in claim 13; and a wire-line extending through the tubular member and coupled to the ignition device, said ignition device being actuatable by an electrical signal sent through the wire-line.

18. The wellbore as claimed in claim 13, said fuel cell being formed of a material which, once ignited, can continue to burn without using an external heat source or external oxygen.

19. The wellbore as claimed in claim 13, said tubular member being production tubing.

20. The wellbore as claimed in claim 13, said tubular member being a well casing.

* * * * *

UNITED STATES PATENT AND TRADEMARK OFFICE

CERTIFICATE OF CORRECTION

PATENT NO. : 6,561,274 B1 
DATED : May 13, 2003
INVENTOR(S) : Kenneth R. Sundberg and Anthony V. Hayes It is certified that error appears in the above-identified patent and that said Letters Patent is hereby corrected as shown below:

Column 7,
Line 15, insert -- wherein -- after "2,".
Lines 16 and 23, delete "including" and insert therefor -- includes --.
Line 22, insert -- wherein -- after "3,".

Signed and Sealed this

Ninth Day of September, 2003

JAMES E. ROGAN
*Director of the United States Patent and Trademark Office*